US009310122B2

(12) United States Patent
Kim et al.

(10) Patent No.: US 9,310,122 B2
(45) Date of Patent: Apr. 12, 2016

(54) REFRIGERATOR AND DISPENSER OF REFRIGERATOR

(75) Inventors: Jin Woo Kim, Changwon-si (KR); Se Joo Ryu, Changwon-si (KR); Ung Su Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 744 days.

(21) Appl. No.: 13/880,579

(22) PCT Filed: Mar. 14, 2011

(86) PCT No.: PCT/KR2011/001750

§ 371 (c)(1), (2), (4) Date: May 22, 2013

(87) PCT Pub. No.: WO2011/115393

PCT Pub. Date: Sep. 22, 2011

(65) Prior Publication Data

US 2013/0233888 A1 Sep. 12, 2013

(30) Foreign Application Priority Data

Mar. 15, 2010 (KR) ..... 10-2010-0022620

(51) Int. Cl.

| | |
|---|---|
| ***B67D 7/84*** | (2010.01) |
| ***F25D 23/00*** | (2006.01) |
| ***F25D 23/12*** | (2006.01) |

(52) U.S. Cl.

CPC ..... *F25D 23/00* (2013.01); *F25D 23/126* (2013.01)

(58) Field of Classification Search

CPC .. F25D 23/00; F25D 23/126; F25D 2323/122

USPC ..... 222/173; 62/389, 98; 239/600; 285/334.2, 394–396, 402

See application file for complete search history.

(56) References Cited

U.S. PATENT DOCUMENTS

| | | | | |
|---|---|---|---|---|
| 5,297,400 | A * | 3/1994 | Benton et al. | 62/389 |
| 5,787,724 | A * | 8/1998 | Pohl et al. | 62/389 |
| 5,819,547 | A * | 10/1998 | Oh | 62/188 |
| 7,163,163 | B2 * | 1/2007 | Waddelow | 239/597 |
| 2002/0163194 | A1 * | 11/2002 | Mintz et al. | 285/361 |
| 2004/0206106 | A1 * | 10/2004 | Lee | 62/389 |
| 2004/0211209 | A1 * | 10/2004 | Olive et al. | 62/348 |
| 2004/0211790 | A1 * | 10/2004 | Werth | 222/212 |
| 2006/0022465 | A1 * | 2/2006 | Yamauchi | 285/402 |
| 2006/0080991 | A1 * | 4/2006 | An et al. | 62/389 |
| 2008/0202147 | A1 * | 8/2008 | Lim et al. | 62/389 |

(Continued)

FOREIGN PATENT DOCUMENTS

| | | | |
|---|---|---|---|
| KR | 99-0036002 | U | 9/1999 |
| KR | 99-0073721 | A | 10/1999 |

(Continued)

*Primary Examiner* — J. Casimer Jacyna
*Assistant Examiner* — Benjamin R Shaw
(74) *Attorney, Agent, or Firm* — Birch, Stewart, Kolasch & Birch, LLP

(57) ABSTRACT

Provided is a refrigerator including a cabinet, a door, a dispenser, a water supply pipe, and a nozzle. The cabinet defines a storage space. The door opens and closes the storage space. The dispenser is disposed on a front surface of the door and dispenses water or ice. The water supply pipe is disposed on an inner part of the door and supplies water to the dispenser. The nozzle is removably coupled to an outer part of the dispenser. An end of the water supply pipe is inserted in the nozzle to dispense water.

5 Claims, 5 Drawing Sheets

(56) References Cited

U.S. PATENT DOCUMENTS

| | | | | |
|---|---|---|---|---|
| 2009/0241782 | A1* | 10/2009 | Van Dillen et al. | 99/279 |
| 2010/0043479 | A1* | 2/2010 | Kim | 62/389 |
| 2010/0175415 | A1* | 7/2010 | Kim | 62/389 |
| 2010/0175783 | A1* | 7/2010 | Kim | 141/198 |
| 2010/0218541 | A1* | 9/2010 | Kim | 62/340 |
| 2010/0307184 | A1* | 12/2010 | Jung | 62/389 |
| 2010/0319389 | A1* | 12/2010 | Yang et al. | 62/389 |

FOREIGN PATENT DOCUMENTS

| | | | |
|---|---|---|---|
| KR | 10-2005-0119436 | A | 12/2005 |
| KR | 10-2006-0056185 | A | 5/2006 |

* cited by examiner

REFRIGERATOR AND DISPENSER OF REFRIGERATOR

TECHNICAL FIELD

The present disclosure relates to a refrigerator and a dispenser of the refrigerator.

BACKGROUND ART

Refrigerators are electric appliances for storing foods at low temperature in a storing space closed by a door. The storing space is cooled with cool air that exchanges heat with refrigerant in refrigeration cycles, thereby storing foods in an optimal state.

Along with the change of people's eating patterns and preferences, large and multifunctional refrigerators have been introduced, and various comfortable structures have been added to refrigerators.

For example, a refrigerator may include a dispenser for dispensing water or ice from the refrigerator without opening a door of the refrigerator. Such a dispenser is installed on an exterior part of a refrigerator door, and dispenses water or ice according to a user's operation.

The dispenser is connected to a water supply pipe for supplying water to the dispenser, and the water supply pipe is coupled to the dispenser to be integrally installed on the door.

Thus, when the water supply pipe is clogged or damaged to affect the dispensing of water, the dispenser is removed to replace the water supply pipe.

Also, it may be difficult to remove or re-install the dispenser on the assembled door. In this case, it is also difficult to replace the water supply pipe with a new one.

DISCLOSURE OF INVENTION

Technical Problem

Embodiments provide a refrigerator and a dispenser of the refrigerator, in which a nozzle connected to a water supply pipe is removably coupled to the dispenser, thereby improving assembling and maintenance thereof.

Solution to Problem

In one embodiment, a refrigerator includes: a cabinet defining a storage space; a door opening and closing the storage space; a dispenser disposed on a front surface of the door and dispensing water or ice; a water supply pipe disposed on an inner part of the door and supplying water to the dispenser; and a nozzle removably coupled to an outer part of the dispenser, an end of the water supply pipe being inserted in the nozzle to dispense water.

The nozzle may be coupled to a dispenser cover forming an appearance of the dispenser.

The dispenser may include a dispenser coupling part at a side to couple to the nozzle, and the nozzle may include a nozzle coupling part having a shape corresponding to the dispenser coupling part.

The nozzle coupling part may include a locking protrusion that protrudes outward and is locked on the dispenser coupling part.

The dispenser coupling part may include: a nozzle insertion hole in which the nozzle coupling part is inserted; a protrusion insertion hole disposed outside the nozzle insertion hole and having an open shape corresponding to the locking protrusion; and a protrusion guide guiding and locking a movement of the locking protrusion when the nozzle inserted in the nozzle insertion hole rotates.

The nozzle may be obliquely installed on the dispenser such that an open lower surface of the nozzle is directed forward and downward.

The nozzle may include an inclination part that contacts the dispenser when the nozzle is installed on the dispenser, and the inclination part may be inclined such that an outlet of the nozzle is directed forward and downward.

The nozzle may include a pipe fixing part to which the end of the water supply pipe is fixed.

The pipe fixing part may include ribs protruding inward and contacting an outer surface of the water supply pipe.

The pipe fixing part may decrease in diameter downward from an open upper surface thereof.

The refrigerator may include a pipe guide member on the inner part of the door, wherein the pipe guide member has a pipe shape and extends from a rear surface of the door to the nozzle to accommodate the water supply pipe.

In another embodiment, a dispenser for a refrigerator includes: a dispenser cover defining a space recessed from a front surface of a refrigerator door; a dispenser coupling part passing through the dispenser cover; a nozzle disposed on an outer part of the dispenser cover and removably coupled to the dispenser coupling part and exposed to an outside to dispense water to the outside; and a water supply pipe disposed on an inner part of the door and connected to the nozzle to supply the water.

The nozzle may include a nozzle coupling part having a shape corresponding to the dispenser coupling part.

The nozzle coupling part may include a locking protrusion that protrudes outward and is locked on the dispenser coupling part.

The dispenser coupling part may include: a nozzle insertion hole in which the nozzle coupling part is inserted; a protrusion insertion hole disposed outside the nozzle insertion hole and having an open shape corresponding to the locking protrusion; and a protrusion guide guiding and locking a movement of the locking protrusion when the nozzle inserted in the nozzle insertion hole rotates.

The nozzle may include an outlet that is directed to front and lower sides of the dispenser cover.

The nozzle may include an inclination part having an inclination surface around the nozzle, and the inclination part may contact an upper surface of the dispenser cover when the nozzle is installed on the dispenser.

The nozzle may include a pipe fixing part having parts that are spaced a constant distance from one another on an inner surface of the nozzle and protrude in a radial shape, and the water supply pipe may be inserted and press-fit coupled to the pipe fixing part.

The pipe fixing part may decrease in diameter downward from an open surface thereof.

The details of one or more embodiments are set forth in the accompanying drawings and the description below. Other features will be apparent from the description and drawings, and from the claims.

Advantageous Effects of Invention

According to the embodiment, an end of the water supply pipe is coupled to the nozzle, and the nozzle is removably coupled to the dispenser.

When the water supply pipe is clogged or damaged, the nozzle may be removed from the dispenser and the water supply pipe, and then, the water supply pipe may be removed from the door.

Then, the water supply pipe is repaired or replaced with a new one, and is coupled to the nozzle, and the nozzle is installed again on the dispenser.

Thus, the replacement and maintenance of the water supply pipe are improved and facilitated.

In addition, since the dispenser is coupled to the door before the assembling of the water supply pipe, an assembly process is facilitated, thereby improving the productivity.

MODE FOR THE INVENTION

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Although a bottom freezer type refrigerator in which a freezer compartment is disposed under a refrigerator compartment is exemplified for convenience in the embodiments, the present disclosure may be applied to any refrigerator including a dispenser.

Figure 1:
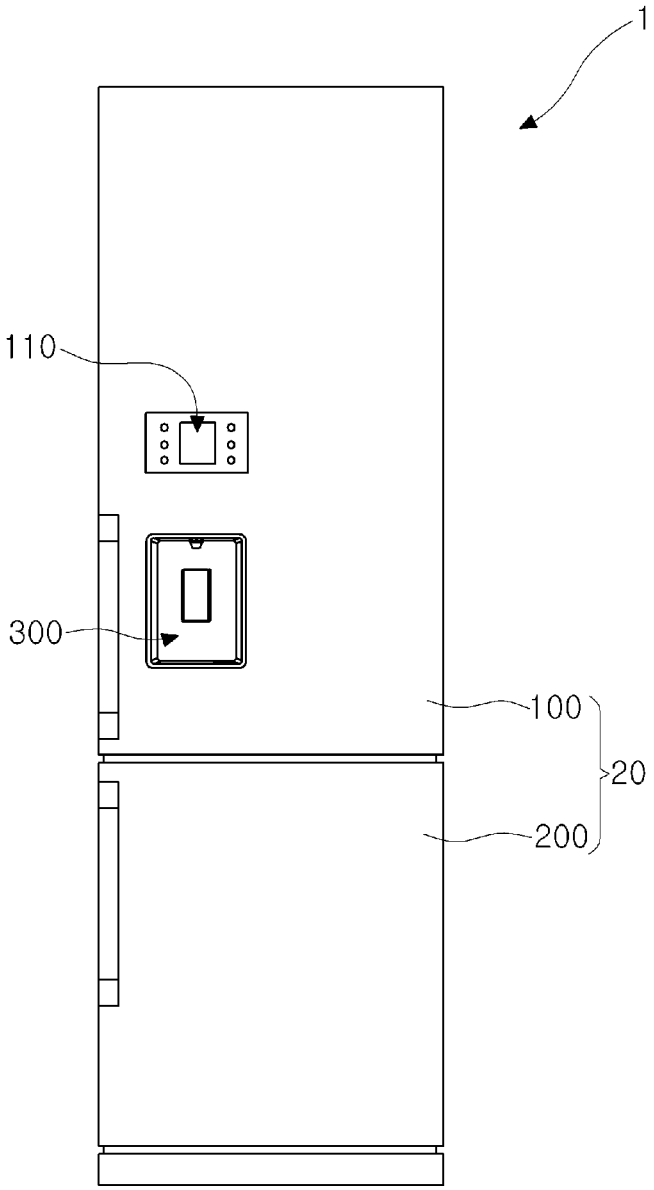
FIG. 1 is a front view illustrating a refrigerator according to an embodiment.
Figure 2:
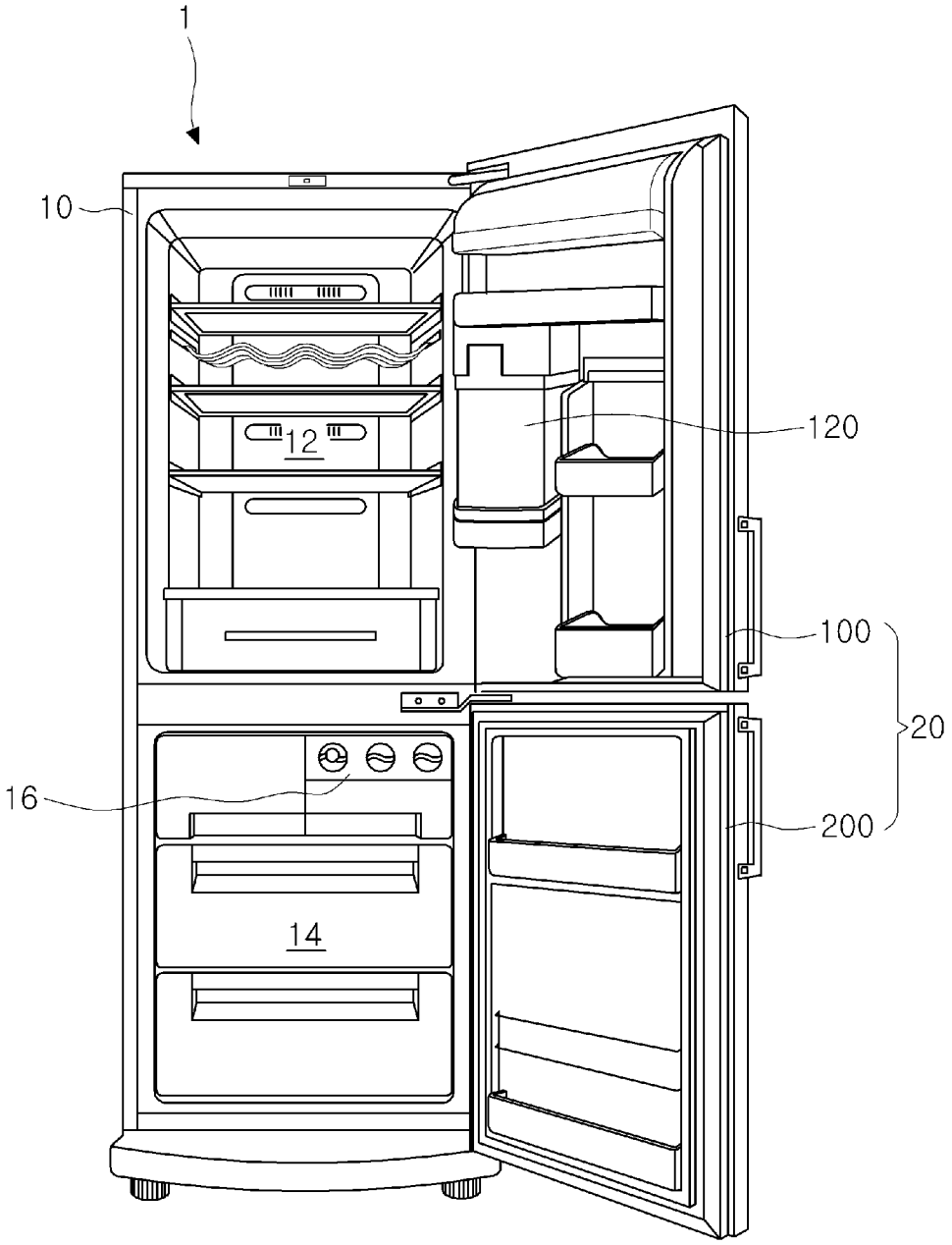
FIG. 2 is a perspective view illustrating a refrigerator when a door is opened, according to an embodiment.

FIG. 1 is a front view illustrating a refrigerator according to an embodiment. FIG. 2 is a perspective view illustrating a refrigerator when a door is opened, according to an embodiment.

Referring to FIGS. 1 and 2, an appearance of a refrigerator 1 according to an embodiment is formed by a cabinet 10 that has a storage space therein, and doors 20 that open and close the storage space.

The storage space is divided into an upper part and a lower part, which function as a refrigerator compartment 12 and a freezer compartment 14, respectively. The doors 20 may include a refrigerator door 100 and a freezer door 200, which open and close the refrigerator compartment 12 and the freezer compartment 14, respectively.

The refrigerator door 100 includes a display 110 for displaying operation states of the refrigerator 1. The display 110 may include buttons for adjusting operations of the refrigerator 1.

The refrigerator door 100 includes a dispenser 300. The dispenser 300 dispenses purified water or ice formed in the refrigerator 1. The dispenser 300 will be described later in detail. In another embodiment, the dispenser 300 may be provided to a freezer door.

Storing members such as a shelf and a drawer may be disposed inside the refrigerator compartment 12. Storing member such as a basket may be disposed on the rear surface of the refrigerator door 100.

A water tank 120 may also be disposed on the rear surface of the refrigerator door 100. The water tank 120 stores water to be supplied to the dispenser 300. The water tank 120 may be removed from the rear surface of the refrigerator door 100 to fill the water tank 120 with water.

Water may be supplied to the dispenser 300 through a passage directly connected to a water pipe, instead of the water tank 120. A storage tank for temporarily storing water may be disposed in the passage. The passage may be branched to supply water to an ice maker for making ice.

Storing members such as a drawer and a shelf may be disposed inside the freezer compartment 14. An ice maker 16 for making ice may be disposed inside the freezer compartment 14. In another embodiment, the ice maker 16 may be provided to a refrigerator or a refrigerant door, and be dispensed with a dispenser.

Figure 3:
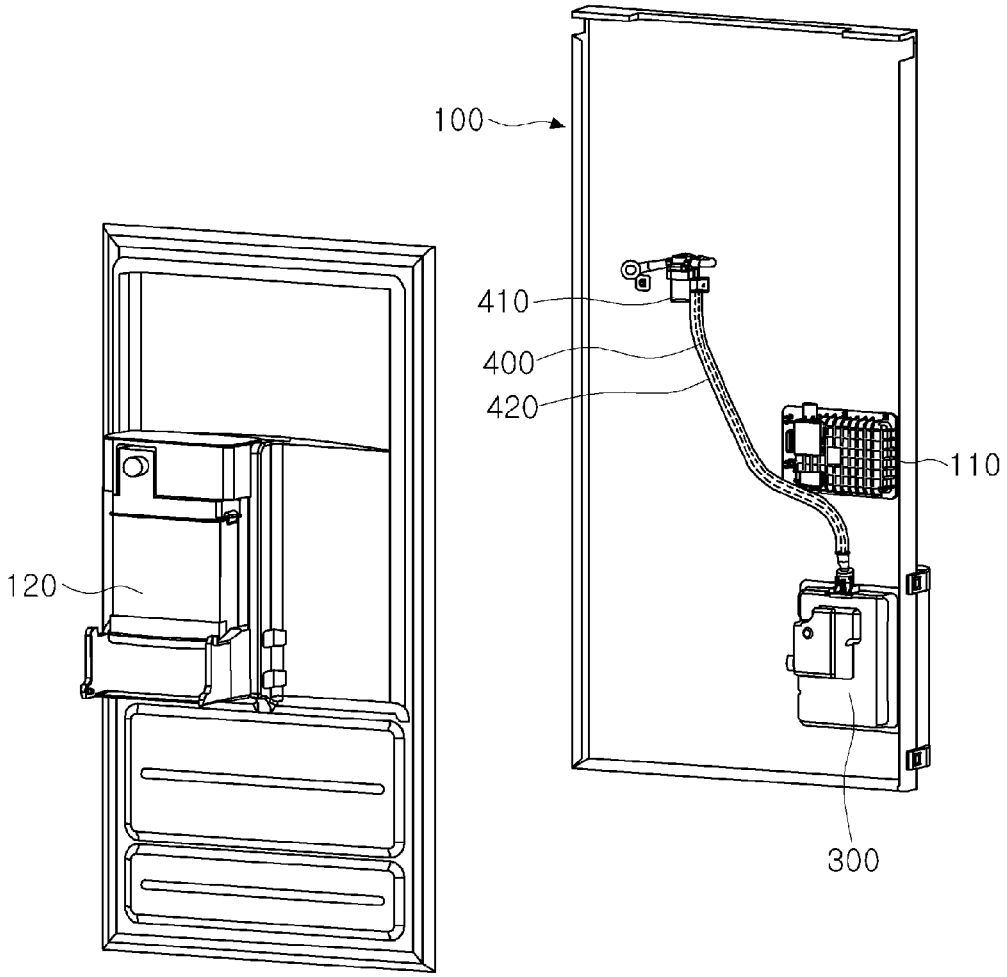
FIG. 3 is an exploded perspective view illustrating the refrigerator door.

FIG. 3 is an exploded perspective view illustrating the refrigerator door.

Referring to FIG. 3, the refrigerator door 100 includes an out plate forming the front surface thereof, and a door liner forming the rear surface thereof. An insulating material is disposed between the out plate and the door liner.

The dispenser 300 is disposed on the front surface of the refrigerator door 100, and the water tank 120 is disposed on the rear surface thereof. The water tank 120 is connected to the dispenser 300 through a water supply pipe 400, so that water can be supplied from the water tank 120 to the dispenser 300.

At least one portion of the water supply pipe 400 is flexible. An end of the water supply pipe 400 may pass through the rear surface of the refrigerator door 100 and be inserted in the water tank 120. The other end of the water supply pipe 400 is coupled to a nozzle 500 provided to the dispenser 300. The water supply pipe 400 may be connected to a water purification filer or a pump 410, and be formed by connecting pipes.

A pipe guide member 420 is disposed on the inner side of the refrigerator door 100. The pipe guide member 420 guides the water supply pipe 400. In detail, the pipe guide member 420 has a tube shape having a diameter corresponding to the water supply pipe 400, and accommodates the water supply pipe 400. The pipe guide member 420 extends to the dispenser 300 from the rear surface of the refrigerator door 100 provided with the water tank 120.

The pipe guide member 420 disposed on the inner part of the refrigerator door 100 may be fixed with an insulating material filling the refrigerator door 100. Thus, the water supply pipe 400 can be removed through the pipe guide member 420.

Figure 4:
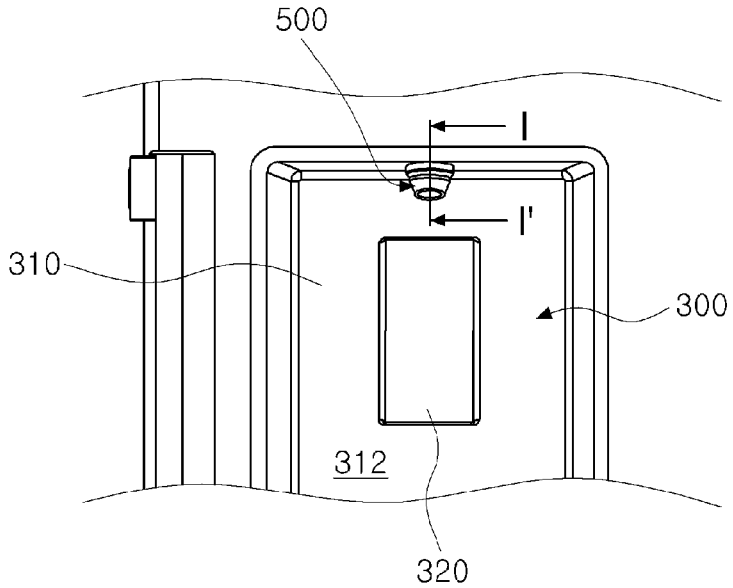
FIG. 4 is a schematic view illustrating an appearance of a dispenser according to an embodiment.
Figure 5:
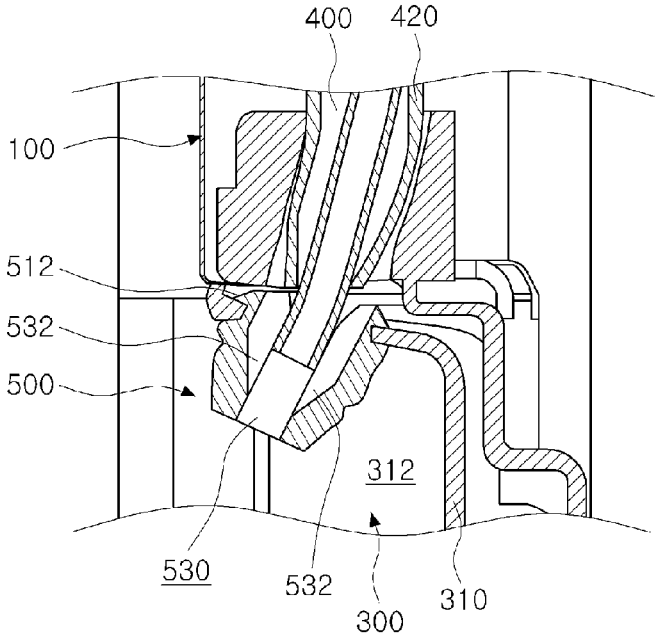
FIG. 5 is a cross-sectional view taken along line I-I' of FIG. 4.

FIG. 4 is a schematic view illustrating an appearance of a dispenser according to an embodiment. FIG. 5 is a cross-sectional view taken along line I-I' of FIG. 4.

Referring to FIGS. 4 and 5, an appearance of the dispenser 300 is formed by a dispenser cover 310. The dispenser cover 310 is recessed inward and is installed on the front surface of the refrigerator door 100 to form a recess 312. The recess 312 is recessed inward from the refrigerator door 100 to provide a space for receiving a container to which water is dispensed.

The nozzle 500 is disposed approximately in the middle of the upper surface of the dispenser cover 310. The nozzle 500 is coupled to an end of the water supply pipe 400 to function as an outlet for dispensing water, and is removably installed on the dispenser cover 310.

A dispensing manipulation member 320 is disposed under the nozzle 500. The dispensing manipulation member 320 is manipulated to dispense water through the dispenser 300 and may be configured in the form of a lever or button. The dispensing manipulation member 320 and the nozzle 500 are disposed on the same line, so that a process of pressing the dispensing manipulation member 320 by a container and a process of dispensing water can be performed at the same time.

Figure 6:
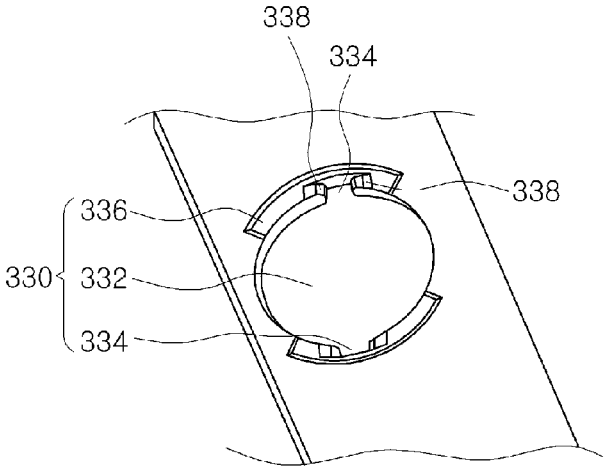
FIG. 6 is a partial perspective view illustrating a dispenser cover according to an embodiment.
Figure 7:
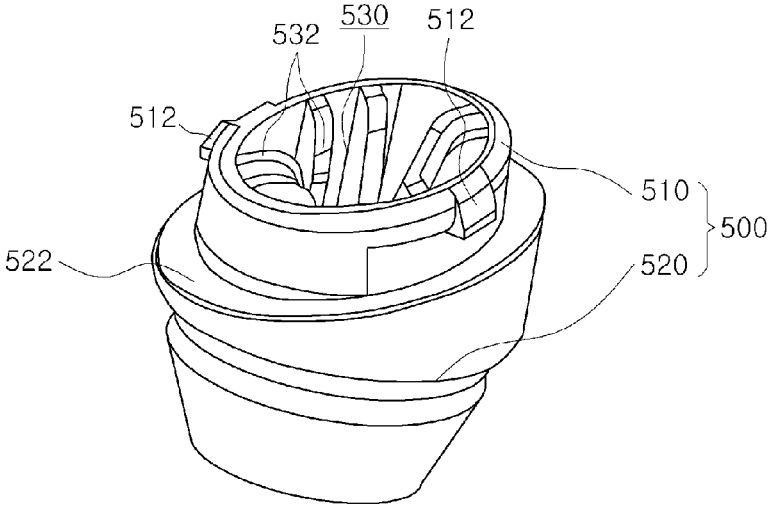
FIG. 7 is a perspective view illustrating a nozzle according to an embodiment.

FIG. 6 is a partial perspective view illustrating a dispenser cover according to an embodiment. FIG. 7 is a perspective view illustrating a nozzle according to an embodiment.

Referring to FIGS. 5 to 7, a dispenser coupling part 330 to which the nozzle 500 is coupled is disposed approximately in the middle of the dispenser cover 310. The dispenser coupling part 330 includes a nozzle insertion hole 332, protrusion insertion holes 334, and protrusion guides 336.

In detail, the upper part of the nozzle 500, that is, a nozzle coupling part 510 to be described later is inserted in the nozzle insertion hole 332 that passes through the upper surface of the dispenser cover 310 and has a shape corresponding to the nozzle coupling part 510. Thus, the nozzle 500 can be moved upward from the recess 312, and inserted into the nozzle insertion hole 332.

The protrusion insertion holes 334 are disposed at both sides of the nozzle insertion hole 332. The protrusion insertion holes 334 have an open shape to receive locking protrusions 512 to be described later. Thus, when the nozzle 500 is inserted in the nozzle insertion hole 332, the upper part of the nozzle 500 and the locking protrusions 512 pass through the nozzle insertion hole 332 and the protrusion insertion holes 334.

The protrusion guides 336 are disposed near the protrusion insertion holes 334 around the nozzle insertion hole 332. The protrusion guides 336 are stepped down from surroundings of the protrusion guides 336 and have a predetermined width to guide movements of the locking protrusions 512. The protrusion guides 336 may be disposed near the protrusion insertion holes 334 at the sides of the nozzle insertion hole 332.

Inclination surfaces 338 contact the protrusion insertion holes 334 at sides of the protrusion guides 336. The locking protrusions 512 inserted in the protrusion insertion holes 334 are guided by the inclination surfaces 338, and thus, can be efficiently moved to the protrusion guides 336.

Thus, after the upper part of the nozzle 500 and the locking protrusions 512 are inserted through the nozzle insertion hole 332 and the protrusion insertion holes 334, when the nozzle 500 is rotated, the locking protrusions 512 move along the protrusion guides 336. The locking protrusions 512 disposed on the protrusion guides 336 are fixed by the protrusion guides 336.

The nozzle 500 installed on the dispenser coupling part 330 is disposed approximately in the middle of the dispenser 300. A hole passes through the central part of the nozzle 500, so that the nozzle 500 coupled to an end of the water supply pipe 400 can dispense water.

In detail, the nozzle 500 may include the nozzle coupling part 510 that is installed on the dispenser coupling part 330, and an exterior part 520 that is exposed to the outside when being installed on the dispenser 300.

The nozzle coupling part 510 coupled to the dispenser coupling part 330 has a shape corresponding thereto, so that the nozzle 500 can be fixed to the dispenser cover 310. The nozzle coupling part 510 has a circular cross-section corresponding to the nozzle insertion hole 332 and extends upward.

The locking protrusions 512 are disposed at both the sides of the nozzle coupling part 510. The locking protrusions 512 are formed at positions corresponding to the protrusion insertion holes 334. Thus, when the nozzle coupling part 510 is inserted into the nozzle insertion hole 332, the locking protrusions 512 are inserted into the protrusion insertion holes 334.

Protrusion lengths of the locking protrusions 512 increase to the lower side thereof, and an outer surface thereof is inclined. Thus, when the nozzle coupling part 510 is inserted into the nozzle insertion hole 332, the locking protrusions 512 can be easily inserted into the protrusion insertion holes 334. When the nozzle coupling part 510 inserted in the nozzle insertion hole 332 is rotated, lower surfaces protruding from the locking protrusions 512 are in surface contact with the protrusion guides 336 and locked.

The central part of the nozzle 500 through which a hole vertically passes is provided with a pipe fixing part 530 in which the front end of the water supply pipe 400 is inserted. The pipe fixing part 530 decreases in inner diameter downward from the upper surface of the nozzle 500. Thus, the water supply pipe 400 can be efficiently inserted in the pipe fixing part 530, and be press-fit coupled to the pipe fixing part 530.

Ribs 532 extending to the center of the nozzle 500 are disposed inside the pipe fixing part 530. The ribs 532 may be elongated in the up-and-down direction of the pipe fixing part 530 and be spaced a constant distance from one another in a radial shape inside the pipe fixing part 530. The ribs 532 may be inclined such that the inner space of the pipe fixing part 530 becomes narrower from the upper part of the pipe fixing part 530 to the lower part thereof.

The exterior part 520 is directed forward from the nozzle coupling part 510 and has a recessed part. Thus, an opening of the lower end of the nozzle 500 is directed forward and downward to dispense water.

The lower end of the nozzle coupling part 510 has a different inner diameter from that of the exterior part 520. Thus, the upper surface of the exterior part 520 includes an inclination part 522 that protrudes from an outer surface of the nozzle coupling part 510. The inclination part 522 is inclined with respect to the lower surface of the nozzle 500 and is in surface contact with the dispenser cover 310 when the nozzle 500 is installed on the dispenser coupling part 330. Thus, the exterior part 520 is exposed forward and downward.

Hereinafter, functions of the refrigerator configured as described above will now be described according to an embodiment.

Figure 8:
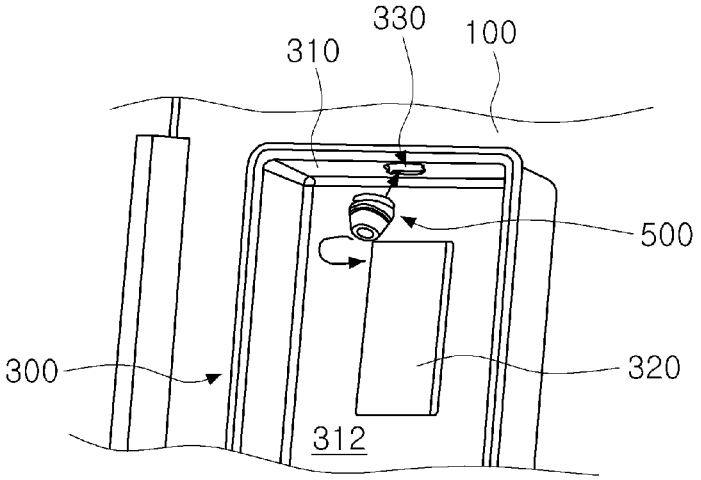
FIG. 8 is an exploded perspective view illustrating a coupling structure of the nozzle.
Figure 9:
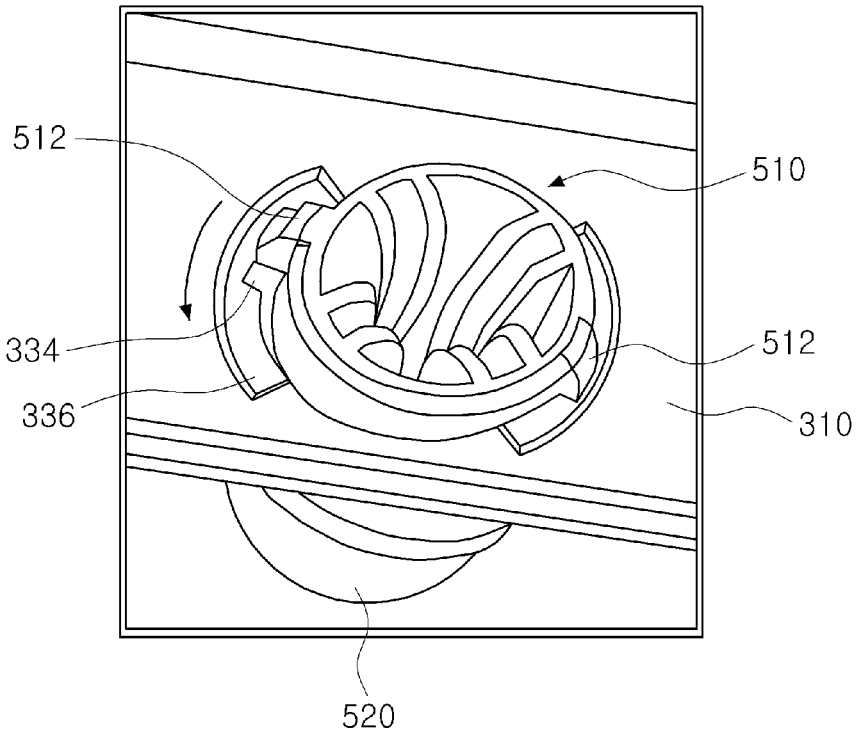
FIG. 9 is schematic views illustrating an installation state of the nozzle.

FIG. 8 is an exploded perspective view illustrating a coupling structure of the nozzle. FIGS. 9 and 10 are schematic views illustrating an installation state of the nozzle.

To assemble the dispenser 300, first, the pipe guide member 420 is disposed inside the refrigerator door 100 when the refrigerator door 100 is assembled. The upper end of the pipe guide member 420 is disposed on the rear surface of the refrigerator door 100, and the lower end of the pipe guide member 420 is disposed at an installation position of the dispenser 300.

In this state, the water supply pipe 400 is inserted into the pipe guide member 420, and the dispenser cover 310 is installed on the refrigerator door 100. At this point, the lower end of the water supply pipe 400 is disposed at a position corresponding to the nozzle insertion hole 332 of the dispenser cover 310.

Then, the exposed lower end of the water supply pipe 400 is inserted into the pipe fixing part 530 of the nozzle 500. After the water supply pipe 400 is coupled to the nozzle 500, the nozzle 500 is brought to the nozzle insertion hole 332 in the upper surface of the dispenser cover 310 as illustrated in FIG. 8. Then, the nozzle coupling part 510 is fixed to the dispenser coupling part 330.

In detail, the nozzle coupling part 510 is inserted in the nozzle insertion hole 332 as illustrated in FIG. 9. When the nozzle coupling part 510 is inserted into the nozzle insertion hole 332, the locking protrusions 512 are also inserted into the protrusion insertion holes 334, and the nozzle coupling part 510 protrudes through the upper surface of the dispenser cover 310.

In this state, the nozzle 500 is rotated counterclockwise as illustrated in FIG. 9. At this point, the locking protrusions 512 rotate along the protrusion guides 336.

In this state, the lower surfaces of the locking protrusions 512 are in close contact with the upper surfaces of the protrusion guides 336, and the locking protrusions 512 are locked on the dispenser cover 310 to fix the nozzle 500.

When the nozzle 500 is fixed, the inclination part 522 is in close contact with the upper surface of the dispenser cover 310, and the exterior part 520 is exposed forward and downward.

To dispense water through the dispenser 300 from the refrigerator 1, the dispensing manipulation member 320 is pressed. When the dispensing manipulation member 320 is pressed, the pump 410 operates to supply water from the water tank 120 through the water supply pipe 400 and the nozzle 500 to the container. When the container contains a predetermined amount of water, the container is removed from the dispensing manipulation member 320 to end the supply of water.

While the refrigerator 1 is in operation, the water supply pipe 400 may be clogged with impurities or be inappropriately used or assembled. In this case, it may be difficult to efficiently supply water through the water supply pipe 400. At this point, it may be needed to replace or disassemble the water supply pipe 400.

To this end, the water tank 120 is removed, and then, the water supply pipe 400 may be partially removed from the rear surface of the refrigerator door 100. When a user holds the exterior part 520 of the nozzle 500 and rotates the nozzle 500, the nozzle coupling part 510 is disposed at the position to allow a removal of the nozzle coupling part 510 from the dispenser coupling part 330 as illustrated in FIG. 9. Then, the nozzle 500 is removed from the dispenser cover 310.

After that, the water supply pipe 400 is removed from the pipe fixing part 530 of the nozzle 500 and is also removed from the pipe guide member 420. After the water supply pipe 400 is completely removed from the refrigerator door 100, the water supply pipe 400 may be replaced with a new one, or a defect of the water supply pipe 400 may be repaired. Then, the water supply pipe 400 and the nozzle 500 are assembled in the reverse order to the above.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A refrigerator comprising:

a cabinet defining a storage space;

a door opening and closing the storage space;

a dispenser disposed on the door and dispensing water or ice;

a water supply pipe extending to the dispenser along an inner part of the door; and a nozzle removably coupled to the dispenser, an end of the water supply pipe being inserted in the nozzle to dispense water, wherein the dispenser comprises:

a dispenser cover defining a front appearance thereof and to which the nozzle is coupled; and a dispenser coupling part defined at an upper surface of the dispenser cover, the nozzle configured to be coupled to the dispenser coupling part, wherein the nozzle comprises one or more locking protrusions protruding from an outer surface thereof, wherein the dispenser coupling part comprises:

a nozzle insertion hole in which the nozzle is inserted;

one or more protrusion guides formed at edge portion of the nozzle insertion hole, the protrusion guides configured to be stepped down from an upper surface of the dispenser cover; and one or more protrusion insertion holes respectively formed in the protrusion guides to allow the one or more locking protrusions to pass through, wherein the nozzle is rotated after the one or more locking protrusion pass through the one or more protrusion insertion holes, and wherein lower surfaces of the one or more locking protrusions slide along the one or more respective protrusion guides such that the nozzle is fixed and locked to the dispenser cover.

2. The refrigerator according to claim 1, wherein the nozzle is obliquely installed on the dispenser such that an open lower surface of the nozzle is directed forward and downward.

3. The refrigerator according to claim 1, wherein the nozzle comprises an inclination part contacting the dispenser cover when the nozzle is installed in the dispenser coupling part.

4. The refrigerator according to claim 3, wherein the nozzle further comprises a plurality of ribs which protrude from an inner surface of the nozzle and extending longitudinally and are in contact with an outer surface of the end of the water supply pipe, wherein the plurality of ribs are arranged to be apart from each other in a circumferential direction of the nozzle.

5. The refrigerator according to claim 1, further comprising a pipe guide member on the inner part of the door, wherein the pipe guide member has a pipe shape and extends from a rear surface of the door to the nozzle to accommodate the water supply pipe.

* * * * *